United States Patent [19]

Iwasaki et al.

[11] 4,115,717

[45] Sep. 19, 1978

[54] STATIONARY ANODE X-RAY TUBE

[75] Inventors: Kenji Iwasaki; Sotaro Hijikata, both of Yokohama, Japan

[73] Assignee: Tokyo Shibaura Electric Co., Ltd., Kawasaki, Japan

[21] Appl. No.: 799,654

[22] Filed: May 23, 1977

[30] Foreign Application Priority Data

May 26, 1976 [JP] Japan ..... 51/60789

[51] Int. Cl.[2] ..... H01J 35/00

[52] U.S. Cl. ..... 313/59

[58] Field of Search ..... 313/59

[56] References Cited

U.S. PATENT DOCUMENTS

| | | | |
|---|---|---|---|
| 3,679,927 | 7/1972 | Kirkendall | 313/59 |
| 3,835,341 | 9/1974 | Zingaro | 313/59 |

FOREIGN PATENT DOCUMENTS

| | | |
|---|---|---|
| 688,829 | 3/1940 | Fed. Rep. of Germany. |
| 1,764,179 | 5/1971 | Fed. Rep. of Germany. |

*Primary Examiner*—Darwin R. Hostetter

*Attorney, Agent, or Firm*—Cushman, Darby & Cushman

[57] ABSTRACT

A stationary anode X-ray tube is provided with an X-ray transmitting window which does not face an inclined electron-impact surface of an anode target and is deflected from the vertical center plane of such electron-impact surface. The deflection angle of the X-ray transmitting window to the vertical center plane of the electron-impact surface, that is, the anode target twist angle to the vertical center plane should preferably be within a range from 30° to 60°.

2 Claims, 6 Drawing Figures

FIG. 1
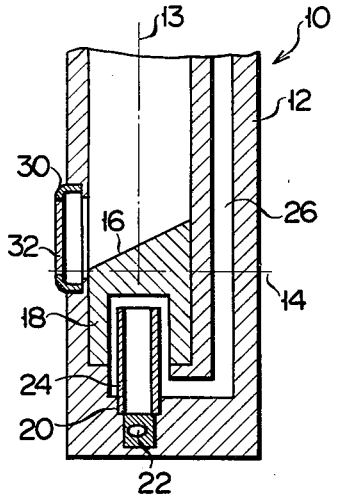
FIG. 2
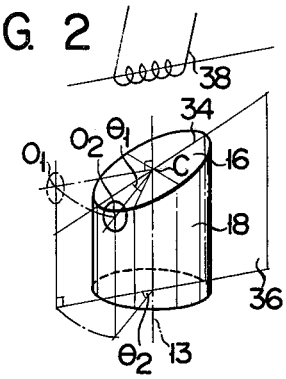
FIG. 3a
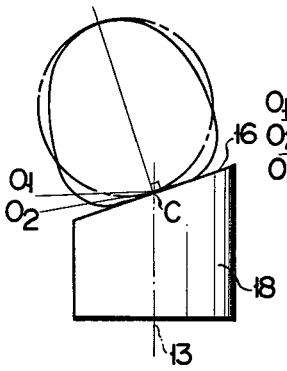
FIG. 3b
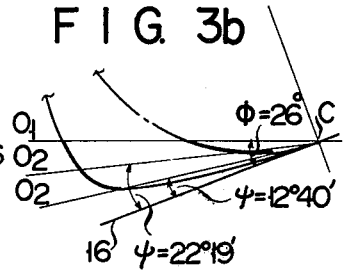
FIG. 4
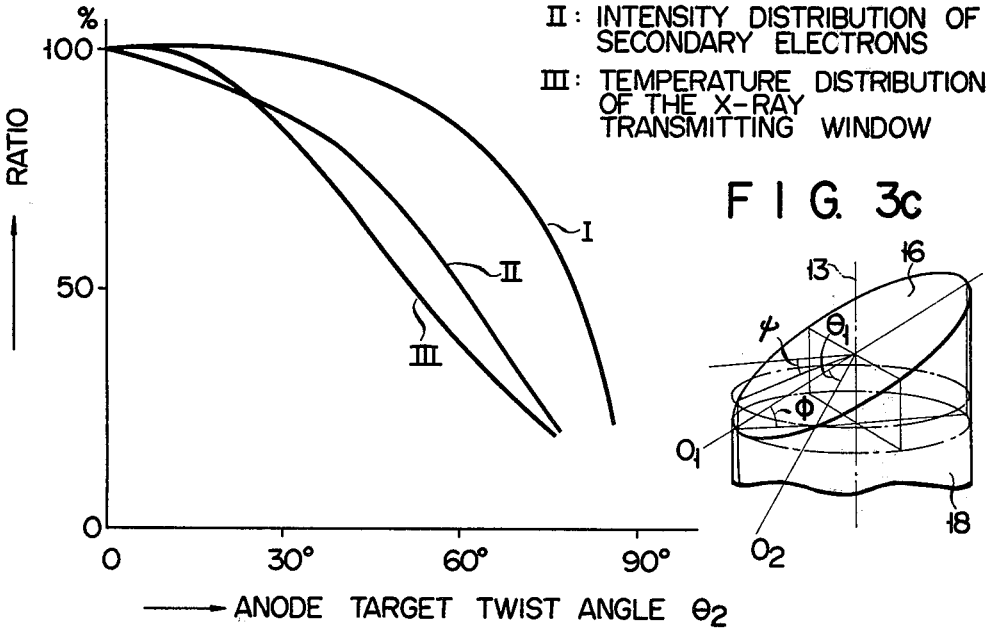
FIG. 3c

STATIONARY ANODE X-RAY TUBE

BACKGROUND OF THE INVENTION

This invention relates to an X-ray tube, in particular to a stationary anode X-ray tube.

The stationary anode X-ray tube generally comprises a cylindrical evacuated envelope, a cathode having a filament and hermetically fixed to one end of the envelope, an anode or anode target hermetically fixed to the other end of the envelope opposite to the cathode, and cooling means disposed on the fixed-end side of the anode target to cool such anode target with a cooling water. The anode target has an electron-impact surface inclined to a horizontal plane perpendicular to the central axis of the anode target. Electrons emitted from the filament of the cathode when heated collide with the electron-impact surface to emanate X-rays in all directions. Here the electron-impact surface is heated to a high temperature by the electron-impact heat. In order to take out X-rays to the outside for effective industrial use, an X-ray transmitting window is attached to the side wall of the envelope adjacent to the anode target.

The X-ray transmitting window has conventionally been made of metal with small atomic number such as beryllium. However, it has been required to reduce the attenuation coefficient of X-rays. The X-ray transmitting window is generally liable to be heated to a high temperature by the radiant and conductive heat from the heated electron-impact surface as well as by collision of scattered electrons such as secondary electrons emitted from the electron-impact surface and stray electrons from the filament; the rise in temperature of the X-ray transmitting window is especially serious since such window is thin. The secondary electrons from the electron-impact surface, among other factors to heat the X-ray transmitting window, contributes much to heating of the X-ray transmitting window. In the conventional stationary anode X-ray tube, it has been very difficult to reduce the thickness of the X-ray transmitting window because such window is located right opposite to the inclined electron-impact surface, so that it is highly liable to be heated under the substantial influence of the secondary electrons.

SUMMARY OF THE INVENTION

It is therefore an object of this invention to provide a stationary anode X-ray tube with a thin X-ray transmitting window.

In order to attain such object, the stationary anode X-ray tube according to the invention includes an X-ray transmitting window which does not face the electron-impact surface and is deflected from the vertical center plane of the electron-impact surface in the circumferential direction. Thus, the relative amount of secondary electrons colliding with the X-ray transmitting window may be reduced by deflecting such window from the vertical center plane of the electron-impact surface. Accordingly, the X-ray transmitting window may not be heated to any high temperature, facilitating use of thinner X-ray transmitting window.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

BRIEF DESCRIPTION OF THE DRAWINGS

FIG. 1 is a partially broken longitudinal sectional view of one preferred embodiment of the invention taken on a plane passing through the center of the X-ray transmitting window and the axis of the evacuated envelope.

FIG. 2 is a perspective view illustrating the positional relation between the vertical center plane of the anode target and the center of the X-ray transmitting window.

FIG. 3*a* is diagrams illustrating the intensity distribution of X-rays and the intensity distribution of secondary electrons.

FIG. 3*b* is an enlarged partial view of FIG. 3*a*, showing the extent of a decrease in the intensity distribution of X-rays and in the intensity distribution of secondary electrons.

FIG. 3*c* is a perspective view showing a relation between a twist angle $\theta_1$ of the anode target and an angle $\psi$ made by the major axis of a twisted anode target with respect to a horizontal plane.

FIG. 4 is a graph illustrating the relation between the anode target twist angle and each of the relative intensity distribution of X-rays, relative intensity distribution of secondary electrons, and relative temperature distribution of the X-ray transmitting window.

DETAILED DESCRIPTION OF THE PREFERRED EMBODIMENT

As shown in FIG. 1, the stationary anode X-ray tube 10 according to this invention comprises a cylindrical evacuated envelope 12, a columnar anode or anode target 18 having an electron-impact surface 16 inclined to a horizontal plane 14 perpendicular to the central axis 13 of the evacuated envelope and hermetically fixed to one end of such envelope, and cooling means 20 attached to the bottom end of the anode target to cool such target. The cooling means 20 includes a traverse passage 22, an upright pipe 24, and a longitudinal passage 26. Cooling medium such as water introduced into the upright pipe 24 through the passage 22 runs against the back of the anode target to cool such target and, thereafter, is discharged through the passage 26 to the outside.

The X-ray tube 10 further comprises a beryllium X-ray transmitting window 32 attached to the side wall of the envelope 12 by means of a mounting flange 30 located adjacently to the electron-impact surface 16.

The electron-impact surface 16 of the columnar anode target 18, as may be seen from FIG. 2, is elliptical. In the prior art, the center $0_1$ of the X-ray transmitting window (indicated by an imaginary line in FIG. 2) used to be located on a plane 36 including the major axis 34 of such elliptical surface and the longitudinal axis 13 of the target. In this case, the plane 36 may be regarded as a vertical center plane because, as viewed from a position right opposite to the electron-impact surface 16, it looks just like a vertical line extending in alignment with the axis 13. In the X-ray tube 10 of this invention, however, the center $O_2$ of the X-ray transmitting window 32 is not located on the vertical center plane 36 but on a plane deflecting from such plane 36 through a deflection angle of $\theta_1$. A cathode filament 38 to emit electrons extends in a direction in line with the major axis 34 of the electron-impact surface 16.

In a conventional stationary anode X-ray tube the center $0_1$ of the X-ray transmitting window is on a horizontal plane passed through the anode target or electron-impact surface as shown in FIGS. 3*a* and 3*b*. According to this invention, however, the intensity of a secondary electron is decreased without leading to little decrease in the intensity of the X-ray distribution. As a result, the center $0_2$ of the X-ray transmitting window 32 is deflected with respect to the vertical center plane 36 so as to decrease the heating temperature of the X-ray transmitting window. It may be taken that the target anode 18, not the center $0_2$ of the X-ray transmitting window is twisted with respect to the vertical center plane. The secondary electron intensity distribution is maximum in a direction of a normal line of the anode target surface 16 and is decreased, by a deflection angle from the normal line, according to a cosine law. The locus gives a substantially spherical, axi-symmetrical distribution with respect to the normal line when plotted by a vector corresponding to the intensity. When, on the other hand, the X-ray intensity distribution is plotted in all directions by a vector corresponding to the intensity, the locus presents an axi-symmetrical distribution with respect to the normal line of the anode target. It is experimentally known that such a locus gives a so-called pear-like contour with the neighborhood of the electron-impact surface bulged. In FIGS. 3*a* and 3*b* the X-ray intensity distribution is indicated in a solid line and the secondary electron intensity distribution in a dot-dash line.

With the tilt angle $\phi$ of the electron-impact surface 16 with respect to the vertical horizontal plane 36 represented by 26°, the secondary electron intensity on the horizontal plane (as mentioned above, the center $0_1$ of the X-ray transmitting window is on the vertical horizontal plane) passing through the center C of the anode target 18. The secondary electron intensity is decreased by a factor of 0.438 of its maximum value in a direction of the normal line of the electron-impact surface. What the target anode 18 is twisted through 30° and 60° with respect to the vertical center plane, the secondary electron intensities will be 0.380-fold and 0.219-fold, respectively and the relative intensity shows a rapid decrease of 86.8% and 50.0%, respectively, in comparison with 0.438 as obtained when untwisted. In consequence, as will be evident from FIG. 4 the relative heating temperatures of the transmitting window can be decreased to about 83% and about 40%, respectively. As will be appreciated from FIG. 3*b*, with $\phi$ and $\theta$ representing the tilt angle of the electron-impact surface and twist angle of the anode target 18, respectively, an angle $\psi$ made by the major axis of the anode target with respect to the horizontal plane can be given as follows (see FIG. 3*c*).

$$\psi = \cos^{-1}\sqrt{\frac{\cos^2\phi + \tan^2\theta_1}{1 + \tan^2\theta_1}}$$

At $\phi = 26°$ and $\theta = 30°$, $\psi$ becomes about 22°19′ and the X-ray intensity will become about 99% in comparison with that at $\psi = \phi = 26°$. With $\phi = 26°$ and $\theta_1 = 60°$, $\psi$ becomes about 12°40′ and the X-ray intensity will become about 85% in comparison with that at $\psi = \phi = 26°$.

As mentioned above, when the anode target 18 is twisted through 30° to 60° with respect to the vertical center plane 36, the relative intensity of the secondary electron can be greatly decreased in spite of no appreciable decrease of the relative intensity of the X-ray (see FIG. 3*b*). In consequence, the relative heating temperature of the transmitting window can be greatly decreased. With an increase in the twist angle $\theta_1$ the relative intensity of the secondary electron and the relative heating temperature of the transmitting window can be greatly decreased. Since, on the other hand, the relative intensity of the X-ray is somewhat decreased, it is preferred that $\theta_1$ be in a range of 30° to 60° in order to secure the relative intensity of the X-ray as required at a practical viewpoint. The twist angle $\theta_1$ is here considered on the electron-impact surface. In a normal tilt angle of the range of $\phi = 20°$ to 30° it is considered as substantially equal to the twist angle $\theta_2$ on the horizontal plane.

As stated above, in the stationary anode X-ray tube of this invention, the center of the X-ray transmitting window is located in the eccentric position reflecting from the vertical center plane of the electron-impact surface, so that the relative amount of secondary electrons from the electron-impact surface colliding with the X-ray transmitting window may be reduced, thereby controlling the rise in temperature of the X-ray transmitting window. Here, the relative intensity of X-rays is reduced only by a small margin to its relative maximum level, and thus the X-ray tube input may be increased while preventing the rise in temperature of the transmitting window. Therefore, use of thinner transmitting window is facilitated and the efficiency of element excitation is increased, so that the range of application as an X-ray tube may be enlarged.

What we claim is:

1. A stationary anode X-ray tube comprising an evacuated envelope, an anode target having an electron-impact surface inclined to a horizontal plane perpendicular to the central longitudinal axis of the anode target and hermetically fixed to one end of the envelope, and an X-ray transmitting window located on the side wall of the envelope adjacent to the anode target, the center of the window deflecting from the vertical center plane of the electron-impact surface in the circumferential direction.

2. A stationary anode X-ray tube according to claim 1 wherein the deflection angle of the X-ray transmitting window to the vertical center plane of the electron-impact surface is within a range from 30° to 60°.

* * * * *